US005432833A

United States Patent [19]

Coe

[11] Patent Number: 5,432,833

[45] Date of Patent: Jul. 11, 1995

[54] AUTOMATIC EXPOSURE CONTROL SYSTEM FOR TOMOGRAPHIC APPLICATIONS

[75] Inventor: Robert P. Coe, Dix Hills, N.Y.

[73] Assignee: Bennett X-Ray Technologies, Copiague, N.Y.

[21] Appl. No.: 246,061

[22] Filed: May 19, 1994

[51] Int. Cl.[6] ..... H05G 1/38

[52] U.S. Cl. ..... 378/110; 378/112; 378/21

[58] Field of Search ..... 378/96, 97, 98.7, 101, 378/107, 108, 109, 110, 111, 112, 116, 19, 21, 22, 4; 371/189, 207, 16, 28

[56] References Cited

U.S. PATENT DOCUMENTS 4,748,649 5/1988 Griesmer et al. ..... 378/108

4,831,260 5/1989 DiBianca ..... 250/354.1

*Primary Examiner*—David P. Porta

*Assistant Examiner*—Don Wong

*Attorney, Agent, or Firm*—Meltzer, Lippe, Goldstein, Wolf, Schlissel & Sazer

[57] ABSTRACT

An automatic exposure control system which regulates the power supplied to an x-ray source of a tomographic apparatus is disclosed. The system includes an x-ray source movably opposing an ionization chamber with a sweeping mechanism and a control for controlling the mechanism. A microprocessor which receives an input reference voltage and combines the voltage with a signal generated by the control to thereby produce a reference signal. This reference signal is then compared with a signal detected by the ionization chamber to determine an output error signal. Power supplied to the x-ray source is then adjusted based on this error signal.

6 Claims, 4 Drawing Sheets

AUTOMATIC EXPOSURE CONTROL SYSTEM FOR TOMOGRAPHIC APPLICATIONS

FIELD OF THE INVENTION

The present invention relates to an automatic exposure control system for tomography. More particularly, the present invention relates to a combination of an automatic exposure control with a mechanical sweeping tomographic system.

BACKGROUND OF THE INVENTION

Tomography is explained in *The Fundamentals of Radiography* (12th Edition) by Eastman Kodak Company, Health Sciences Markets Division, Rochester, N.Y. 1980.

Tomography is a method of reducing the "clutter" of overlying or underlying structures which obscure desired information in a radiograph. It is a technique which provides an image of any selected plane through the body, while blurring out images of structures that lie above or below that plane.

Typically, a tomogram is obtained by a special mechanism that moves the x-ray tube and film in opposite directions simultaneously. FIG. 1 shows one such method.

FIG. 1 is a schematic diagram illustrating a traditional mechanically sweeping tomographic system. The tomographic system has an x-ray tube (3) and an image receptor (11) for receiving the x-ray radiation. The image receptor (11) contains a film (1) which is supported on a Bucky tray (8). During exposure of a patient's body (5), the film (1) and the x-ray tube (3) are moved horizontally in opposite directions as indicated by the arrows (2) and (4). This movement is typically achieved by rotating a lever (not shown) attached to the x-ray tube (3) and the Bucky tray (8) which carries the film (1).

The pivot point (6) or fulcrum about which the lever rotates is adjustable so that any desired horizontal layer within the body (5) can be selected for imaging. The horizontal plane in the body (5) which contains the pivot point (6), about which the x-ray tube (3) and the film (1) move, remains in focus. This is shown in FIG. 1 as the focal plane (7). Structures in this focal plane (7) are not affected by the motion of the x-ray tube (3) and the film (1) in opposite directions (2) and (4). These structures appear as they would in a stationary radiograph. The images of structures above and below the fulcrum or focal plane (7) are blurred by the motion of the x-ray tube (3) and Bucky tray (8) which carries the film (1). The greater their distance from the focal plane (7), the greater the blurring.

There is a region on each side of the focal plane (7) in which the blurring due to the motion (2, 4) does not exceed that arising from other geometric factors and light diffusing in the image receptor (11). Therefore, the thickness of the layer, within the body (5), which can be imaged satisfactorily depends on the characteristics of the recording system, the body (5) involved and the subjective needs of the radiologist. The thickness of this "in-focus" slice depends on the angle (9) through which the x-ray (3) tube moves and the distance (10) of the focal plane (7) from the film (1). The larger the angle of swing (9) and the farther the focal plane (7) is from the film (1), the thinner the cut or section which will be in focus.

In short, the quality of a tomographic system and its ability to focus on a particular layer of a body (5), while filtering unwanted images is a function of various items. It is a function of the accuracy of moving the film (1) and x-ray tube (3) synchronously in opposite directions (2, 4), the accuracy of positioning the fulcrum or pivot point (6) and the accuracy of the interval resolution in which the focal plane distance (10) can be adjusted. The quality of a tomographic system is also a function of the accurate reproducibility of that distance (10), slice thickness of body (5), and x-ray exposure timing.

Throughout the tomographic sweep, two things are essential to image quality. First, maintaining the mechanical center-to-center alignment of the x-ray source or tube (3) to the image receptor (11) during x-ray tube (3) angulation. Second, ensuring the smoothness of the longitudinal travel of the x-ray tube (3) and the image receptor (11).

The accuracy of tomography is dependent upon the angle of swing (9) and centering of the tomographic sweep at the pivot point (6). This accuracy is also dependent on the x-ray exposure timing. Yet, the weight of the tube assembly (not shown) enclosing the x-ray tube (3) and the remaining structure containing the image receptor (11), the Bucky tray (8) and the film (1), can be several hundred to as much as a thousand pounds. This heavy weight makes movement in a controlled and precise manner difficult. Furthermore, for accurate tomography, the time of the sweep has to be correlated to the anticipated exposure time of the film (1). Or, conversely, the film exposure time has to be correlated to the projected sweep time.

Because the film exposure is dependent on the patient and the patient's body density, automatic exposure timing is used in most radiographic applications. Such an automatic exposure control operates as follows. The power settings of the x-ray tube (3), i.e., the kV and mA settings, are selected and the x-ray tube (3) energized. When the desired film density is achieved, an ionization chamber (12) or similar pick up, terminates the exposure.

In one traditional automatic exposure control system, shown in FIG. 2, exposure termination occurs as follows. An ionization chamber (12) generates an ionization current (13) from the x-ray energy passing through the patient's body (5). The ionization chamber (12) is connected to the Bucky tray (8). The ionization current (13) is inputted to an integrator (14). The integrator (14) integrates the ionization current (13). The integrated ionization current (15) is also referred to as a voltage ramp signal (15) shown in FIG. 3.

FIG. 3 is a plot of voltage versus time. The vertical axis represents voltage (16) and the horizontal axis represents time (17). The slope of the ramp signal (15) is proportional to the rate that x-ray energy is passing through the patient. The system sets a reference voltage (18), which is the required voltage to achieve the desired film density. The reference voltage (18) is a maximum threshold voltage, above which exposure is terminated FIG. 3 shows the exposure time (19) on the horizontal time axis (17). The time it takes for the integrated ionization current or voltage ramp signal (15) to cross the reference voltage (18) is the exposure time (19). The optimal time of exposure is dependent on the selected kV and mA settings, and the patient's body size.

As shown if FIG. 2, a cut-off circuit (28) generates a cutoff signal (29) when the amplitude of the ramp signal

(15) reaches a value equal to the reference voltage (18). When the amplitude of the ramp signal (15) equals this reference voltage (18), the generated cut-off signal (29) cuts off the power of the x-ray tube and terminates the exposure.

Tomographic accuracy depends on proper optical density on the film (1) and the proper sweep time for the motion in opposite direction (2, 4) of the film (1) and the x-ray tube (3). Achieving the required optical density on the film (1) and the required sweep time for tomographic accuracy is almost impossible to do at the same time.

It is an object of the present invention to provide an automatic exposure control system for tomographic applications which correlates exposure of the film to the tomographic sweep time.

SUMMARY OF THE INVENTION

This and other objects are achieved by the present invention which provides an automatic exposure control system for use in tomography. The control system correlates the exposure of the film to the tomographic sweep time.

According to one embodiment, an automatic tomographic system has an x-ray system, a mechanical sweep control mechanism and a feedback exposure control system. The feedback exposure control system generates an error signal that adjust the power setting of the x-ray tube. This results in the proper exposure on the film, exactly matched to the tomographic sweep time.

The error signal is the difference between the actual output voltage ramp signal and a desired reference voltage ramp signal. The voltage reference value and tomographic sweep time are preset and used to generate the reference voltage ramp signal.

Illustratively, such an automatic exposure control system has a microprocessor that receives a sweep time value from a mechanical sweep control mechanism. The microprocessor combines the sweep time value with a reference voltage value and outputs a voltage reference ramp signal. The voltage reference ramp signal is a linear increasing voltage signal with time. It linearly increases until it reaches an amplitude equal to a reference voltage level. The time it takes to reach that level is the sweep time.

Meanwhile, in response to the x-ray radiation, an ionization chamber generated an ionization current. An integrator integrates the ionization current generating an integrated ionization current. The integrated ionization current and the reference ramp signal are than compared by a comparator. The comparator outputs an error signal to a high voltage electronics unit which controls the voltage and current of the x-ray tube. In response to the error signal, the high voltage electronics unit adjusts the current and/or voltage of the x-ray tube. When the sweep time is reached, the x-ray exposure process is completed.

The present invention solves the problem of simultaneously correlating and achieving the correct sweep time for blurring out unwanted images and the required optical density on the film. This is accomplished by combining an automatic exposure control with a mechanical sweeping tomographic system. Such a combination provides a more precise tomographic exposure without sacrificing film density or sweep angle.

DETAILED DESCRIPTION OF THE INVENTION

Figure 1:
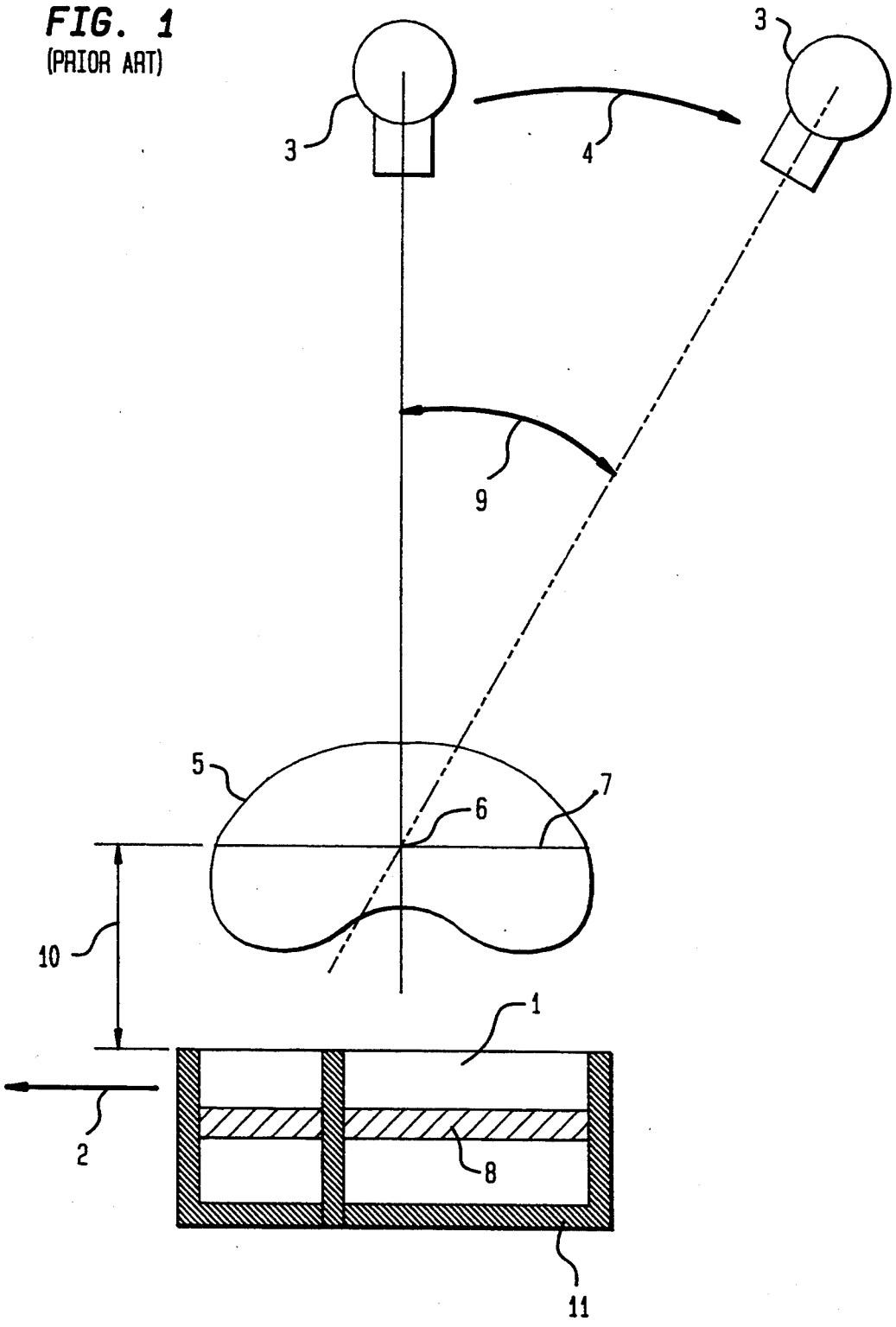
FIG. 1 (PRIOR ART)
FIG. 1 is a schematic diagram illustrating a prior art mechanically sweeping tomographic system.
Figure 2:
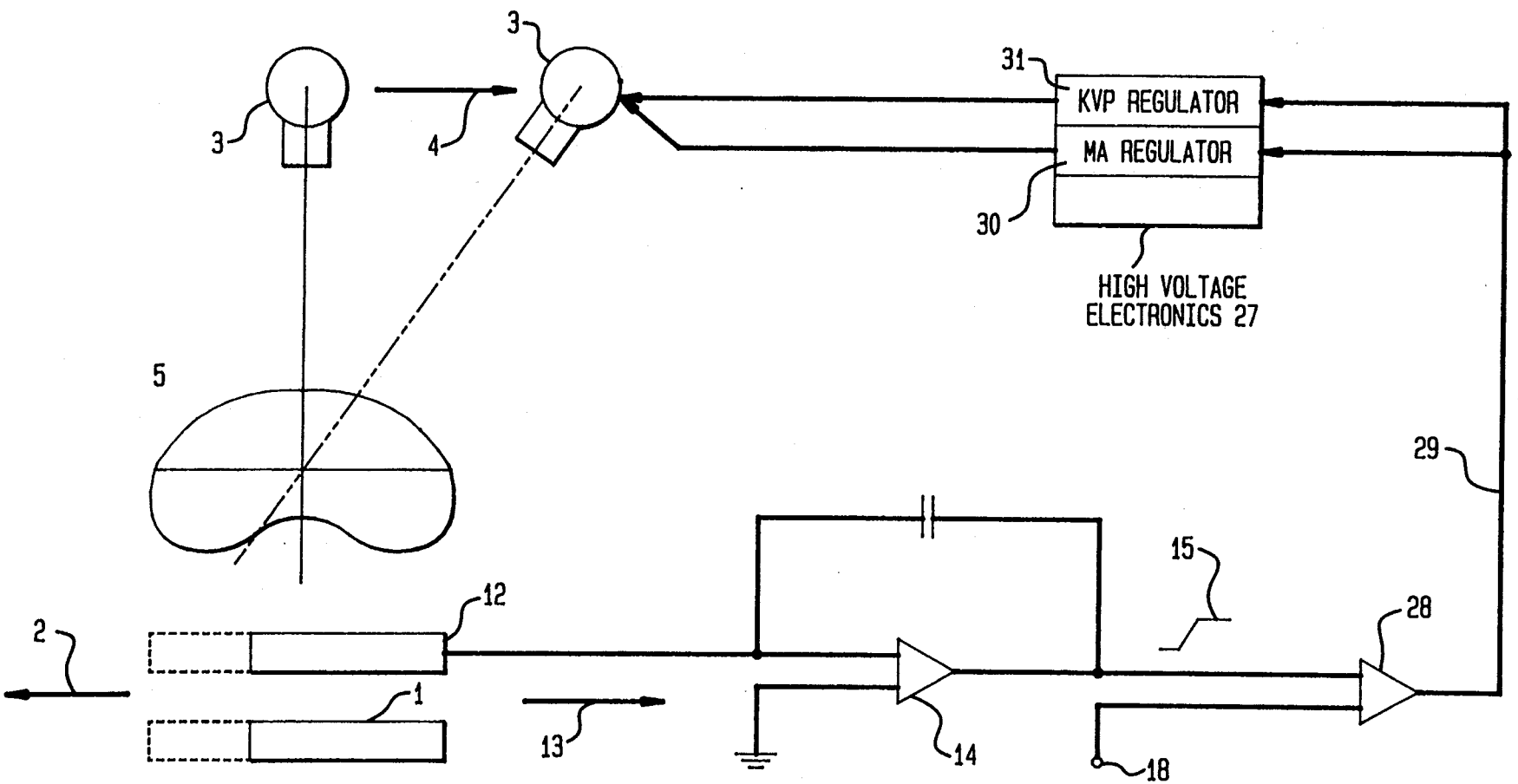
FIG. 2 (PRIOR ART)
FIG. 2 is a schematic diagram illustrating a prior art mechanically sweeping tomographic system with a feedback control system.
Figure 3:
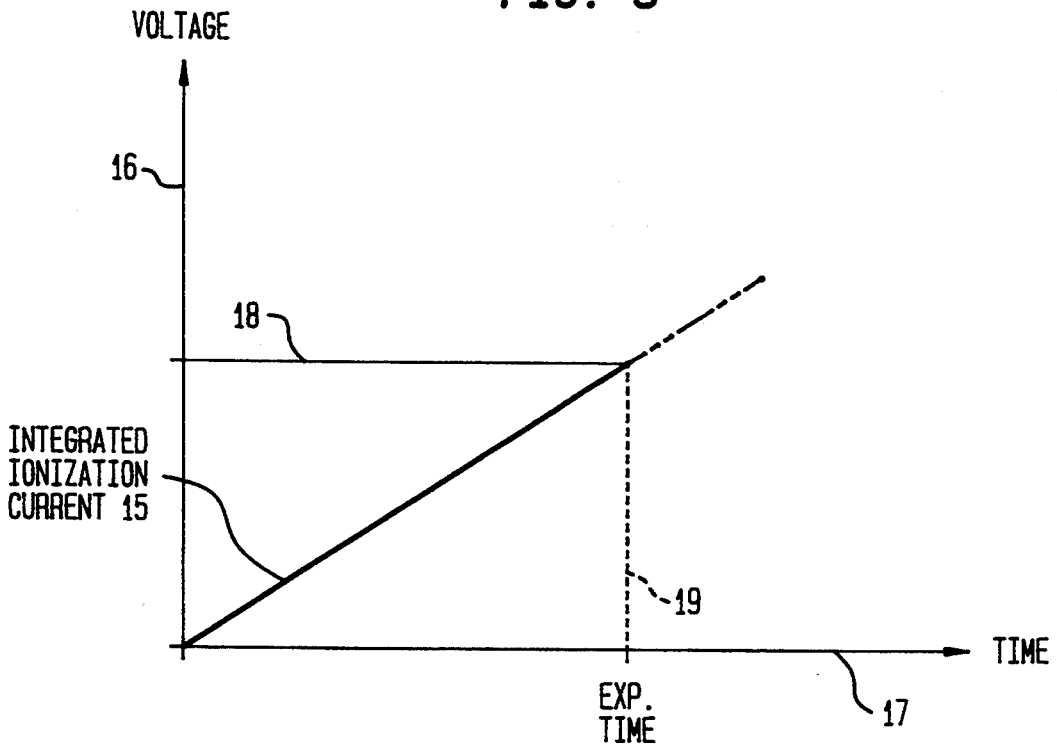
FIG. 3 shows the integrated ionization current which, in traditional automatic exposure control systems, ends when it reaches a predetermined reference voltage.
Figure 4:
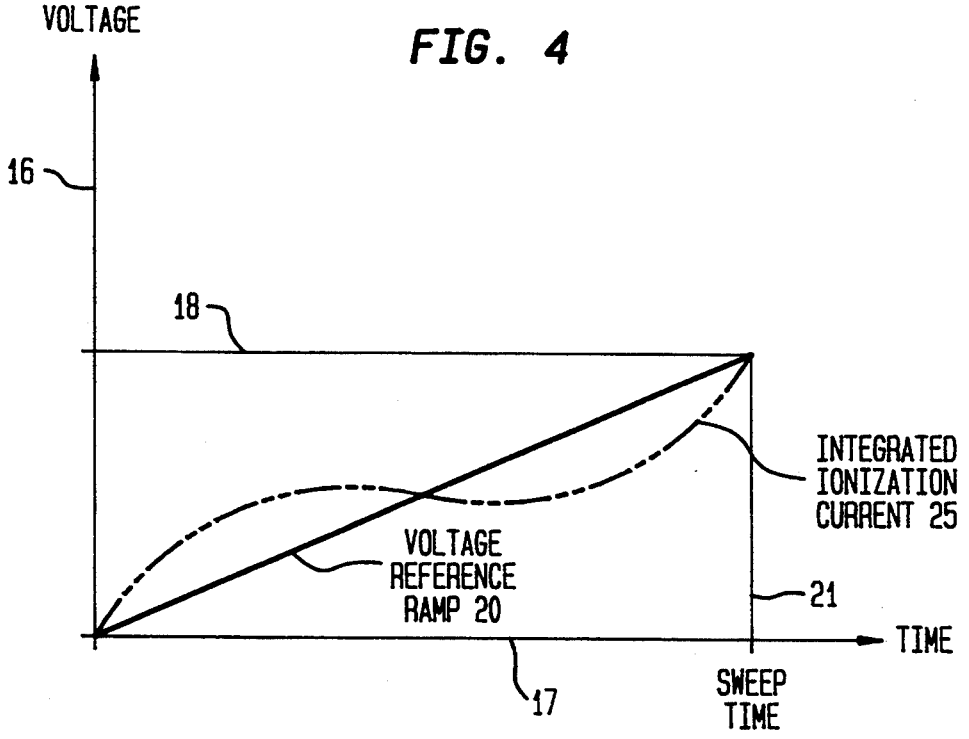
FIG. 4 shows the reference ramp signal generated by the microprocessor of the present invention.
Figure 5:
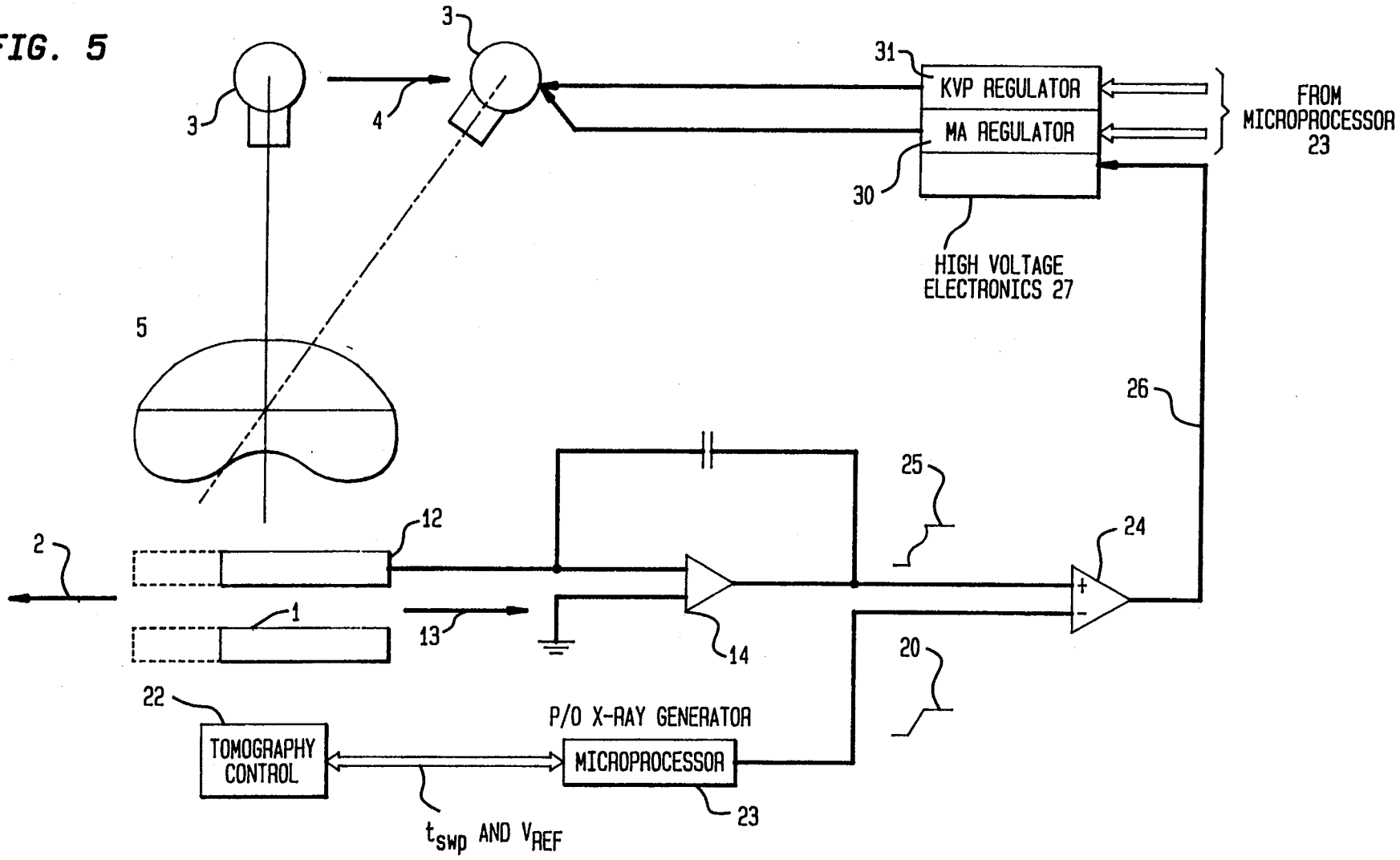
FIG. 5 is a schematic diagram of the present invention, illustrating the automatic exposure control system used in tomography.

FIG. 5 shows the present invention which combines an automatic exposure control system with a mechanical sweeping tomographic system. It has a microprocessor (23) that controls the power settings of the x-ray tube (3) and the exposure time. Additionally, the tomographic mechanical controls (22) are integrated with the x-ray generator's microprocessor (23) so that the microprocessor (23) knows the tomographic sweep time (21) shown in FIG. 4.

The tomography control (22), shown in FIG. 5, controls the mechanical sweep of the tomographic system. It sends to the microprocessor (23) the sweep time (21) and the reference voltage level (18) needed for a proper density of the film (1).

FIG. 4 is a plot of voltage versus time. The vertical axis represents voltage (16) and the horizontal axis represents time (17). The operator sets a reference voltage level (18) and a sweep time (21) using the tomography control (22). The reference voltage level (18) is the required voltage to achieve the desired film density. In prior art configurations, the reference voltage level (18) is used as a maximum threshold voltage, above which exposure is terminated. Whereas in the present invention, it is used to generate a voltage reference ramp signal (20). The sweep time (21) is the time required for the film (1) and the x-ray tube (3) to move, from one extreme of the selected sweep width to the other extreme, in opposite direction (2, 4) shown in FIG. 4.

From the reference voltage (18) and the known sweep time (21), the microprocessor (23) generates a voltage reference ramp signal (20) shown in FIG. 4. It is a linearly increasing voltage signal over time. It linearly increases during the sweep time (21). It terminates when its amplitude reaches the reference voltage level (18) which also corresponds to a time equal to the sweep time (21). This reference ramp signal is inputted to a comparator (24) shown in FIG. 5.

Meanwhile, an ionization chamber (12) generates an ionization current (13) from the x-ray energy passing through the patient. The ionization chamber (12) provides the ionization current (13) to an integrator (14). The integrator (14) integrates the ionization current (13) and provides an integrated ionization current (25) to the comparator (24). The comparator (24) compares its two inputs, the integrated ionization current (25) and the reference ramp signal (20).

Next, the comparator (24) outputs an error signal (26) representing the difference between its two inputs (25, 20). The error signal (26) and signals (23) from the microprocessor are inputted into the high voltage electronics unit (27). These signals adjust the current regulator (30) and the voltage regulator (31) of the high voltage electronics unit (27). Thus, the current of the x-ray tube (3) is adjusted such that the ionization current (12), which is the output of the ionization chamber (12), follows the reference ramp signal (20) outputted from the microprocessor (23). Thus, the error signal (26) outputted from the comparator (24) is minimized. This operation is repeated until the error signal (26) is zero. This results in the proper exposure of the film (1), exactly matched to the tomographic sweep time (21).

In short, an automatic exposure control system for tomographic applications has been disclosed. The invention combines an automatic exposure control system with a mechanical sweeping tomographic system. This provides a more precise tomographic exposure without sacrificing film density or sweep angle.

Finally, the above described embodiments of the invention are intended to be illustrative only. Numerous alternative embodiments may be devised by those skilled in the art without departing from the spirit and scope of the following claims.

I claim:

1. An automatic exposure control system for use in tomography comprising, a mechanical sweep control, an electronic circuit which receives a sweep time signal from said mechanical sweep control, said electronic circuit combines said sweep time signal with a reference voltage value and outputs a reference signal, an integrator which integrates an ionization current received from an ionization chamber and outputs an integrated ionization current, and a comparator which receives and compares said integrated ionization current and said reference signal, and outputs an error signal to a high voltage electronics unit of an x-ray tube.

2. The automatic exposure control system of claim 1 wherein said electronic circuit inputs control signals to said high voltage electronics unit.

3. The automatic exposure control system of claim 1 wherein said high voltage electronics unit has a voltage regulator and a current regulator.

4. The automatic exposure control system of claim 3 wherein said comparator outputs said error signal to said current regulator.

5. An automatic exposure control system for use in tomography comprising, an x-ray tube, a high voltage electronics for regulating power of said x-ray tube, an ionization chamber connected to said x-ray tube, a mechanical sweep system which moves said x-ray tube and said ionization chamber in opposite directions, a feedback control circuit which receives signals from said ionization chamber and from said mechanical sweep system and generates an error signal, said error signal is inputted to said high voltage electronics to adjust power of said x-ray tube, such that said signals from said ionization chamber and from said mechanical sweep system match.

6. The automatic exposure control system of claim 5 wherein said feedback control circuit comprises, a microprocessor which receives a sweep time value from said mechanical sweep control, said microprocessor combines said sweep time value with a reference voltage value and outputs a reference ramp signal, an integrator which integrates an ionization current received from an ionization chamber and outputs an integrated ionization current, and a comparator which receives and compares said integrated ionization current and said reference ramp signal, and outputs an error signal to a high voltage electronics unit of an x-ray tube.

* * * * *